US009687082B2

(12) United States Patent
Huang et al.

(10) Patent No.: US 9,687,082 B2
(45) Date of Patent: Jun. 27, 2017

(54) GAS COMMUNICATION DEVICE

(71) Applicant: APEX MEDICAL CORP., New Taipei (TW)

(72) Inventors: Jian-Cheng Huang, New Taipei (TW); Ming-Lung Chang, New Taipei (TW)

(73) Assignee: APEX MEDICAL CORP., New Taipei (TW)

( * ) Notice: Subject to any disclaimer, the term of this patent is extended or adjusted under 35 U.S.C. 154(b) by 77 days.

(21) Appl. No.: 14/668,298

(22) Filed: Mar. 25, 2015

(65) Prior Publication Data

US 2016/0051060 A1 Feb. 25, 2016

(30) Foreign Application Priority Data

Aug. 25, 2014 (TW) ..... 103129141 A

(51) Int. Cl.

| | |
|---|---|
| ***A47C 27/08*** | (2006.01) |
| ***A61G 7/057*** | (2006.01) |
| ***A61G 13/10*** | (2006.01) |
| ***A61G 13/12*** | (2006.01) |

(52) U.S. Cl.

CPC ..... *A47C 27/081* (2013.01); *A61G 7/05769* (2013.01); *A61G 7/05784* (2016.11); *A61G 13/107* (2013.01); *A61G 13/1265* (2013.01)

(58) Field of Classification Search

CPC A47C 27/081; A61G 7/05769; A61G 13/107; A61G 2007/05784; A61G 13/1265; F16K 35/00; F16K 24/00; F16K 31/528; F16K 31/5282; F16K 31/5286

USPC ..... 137/223, 232; 251/147, 300

See application file for complete search history.

(56) References Cited

U.S. PATENT DOCUMENTS

| | | | | | |
|---|---|---|---|---|---|
| 2,016,678 | A * | 10/1935 | Loomis | B65D 47/14 | 222/512 |
| 3,998,426 | A * | 12/1976 | Isbester | F16K 3/22 | 251/147 |
| 5,692,470 | A * | 12/1997 | Sattler | F02D 9/103 | 123/337 |
| 7,073,545 | B2 * | 7/2006 | Smith | B60P 7/065 | 137/228 |
| 8,584,695 | B2 * | 11/2013 | Lau | F16K 15/202 | 137/232 |
| 2005/0121639 | A1 * | 6/2005 | Delzer | F16K 3/22 | 251/300 |

* cited by examiner

*Primary Examiner* — Michael R Reid
*Assistant Examiner* — Patrick Williams
(74) *Attorney, Agent, or Firm* — Muncy, Geissler, Olds & Lowe, P.C.

(57) ABSTRACT

A gas communication device comprises a main body, at least one gas delivery pipe and a cover. The gas delivery pipe is at least partially disposed in the main body and forms a gas outlet at one end; the cover is movably pivoted to the main body and comprises at least one sealing structure for correspondingly sealing the gas outlet, wherein the cover is movable along an axis relative to the main body and away from the gas outlet so as to break the seal of the sealing structure on the gas outlet such that the cover is rotatable relative to the main body to expose the gas outlet.

16 Claims, 16 Drawing Sheets

GAS COMMUNICATION DEVICE

CROSS-REFERENCE TO RELATED APPLICATIONS

This application claims priority of Taiwan Patent Application No. 103129141, filed on Aug. 25, 2014, the entirety of which is incorporated by reference herein.

FIELD OF THE INVENTION

The present invention relates to a gas communication device and more particularly to a device applicable to gas supply and gas discharge of an air mattress.

BACKGROUND OF THE INVENTION

Devices to be inflated such as medical grade air mattresses are useful for bedridden patients to relieve local stress concentration caused by lying and prevent bedsores. Air mattresses can be inflated when in use, and gas therein can be released in emergency conditions or when the mattresses are not in use to facilitate patient rescue or mattress storage.

Conventional inflation/deflation apparatuses for a device to be inflated such as air mattress generally comprise a gas supplier and a gas communication device. The gas supplier comprises an air pump allowing inflation/deflation mode setting, and the gas communication device is connected between the air mattress and the gas supplier to establish gas communication between the gas supplier and the mattress main body, so as to perform inflation or deflation of the device to be inflated.

In order to rapidly deflate the air mattress in emergency conditions, some conventional gas communication devices are configured with a gas discharge hole communicated with the gas discharge pipeline. The gas discharge hole is usually blocked and sealed by a plug or a sealing switch member. After a user remove the plug or switch on the sealing switch member, the gas discharge pipeline is opened to allow removal of gas in the air mattress from the gas discharge hole. However, because most gas communication devices are arranged adjacent to the air mattress for convenient operation, once the patient unintentionally actuates the plug on the gas discharge hole or the sealing switch member, the plug might be removed or the sealing switch member might be switched on, which undesirably results in the deflation of the air mattress and affects the lying comfort of the patient or even threatens his/her personal safety. Therefore, improvements are needed for the sealing configuration of gas discharge holes of conventional gas communication devices.

SUMMARY OF THE INVENTION

An objective of this invention is to provide a gas communication device useful for inflation and deflation of an air mattress, which can effectively maintain the seal of the gas outlet and allow convenient sealing and unsealing of the gas outlet to switch between inflation and deflation states.

To achieve the aforesaid objective, the gas communication device of this invention comprises a main body, at least one gas delivery pipe and a cover. The gas delivery pipe is at least partially disposed in the main body and forms a gas outlet at one end; the cover is movably pivoted to the main body and comprises at least one sealing structure for correspondingly sealing the gas outlet, wherein the cover is movable along an axis relative to the main body and away from the gas outlet so as to break the seal of the sealing structure on the gas outlet and make the cover rotatable relative to the main body to expose the gas outlet.

In one embodiment, the gas communication device further comprises at least one locking module for limiting the cover from moving or rotating relative to the main body.

Also disclosed herein is an inflation and deflation apparatus comprising a gas communication device and a gas supplier, wherein the gas communication device comprises a main body; at least one gas delivery pipe at least partially disposed in the main body and forming a gas outlet at one end; a cover movably pivoted to the main body, the cover comprising at least one sealing structure for correspondingly sealing the gas outlet and being movable along an axis relative to the main body and away from the gas outlet so as to break the seal of the sealing structure on the gas outlet such that the cover is rotatable relative to the main body to expose the gas outlet; and an engagement structure connected with the gas supplier; and wherein the gas communication device is separable from the gas supplier when the gas communication device is disengaged sequentially from two ends.

The gas communication device may be configured as a removable or separable structure to be rapidly connected with the gas supplier or removed or separated from the gas supplier. For example, the gas communication device has two holes formed respectively on the upper and lower portions engaged with two corresponding connection structures of the gas supplier configured as two hooks. To remove the gas communication device from the gas supplier, users may press the button on the gas communication device to disengage the upper portion and then disengage the lower portion subsequently.

BRIEF DESCRIPTION OF THE DRAWINGS

A more complete understanding of the subject matter can be derived by referring to the detailed description and claims when considered in conjunction with the following figures, wherein like reference numbers refer to similar elements throughout the figures.

DETAILED DESCRIPTION OF THE INVENTION

Since various aspects and embodiments are merely exemplary and not limiting, after reading this specification, skilled artisans appreciate that other aspects and embodiments are possible without departing from the scope of the invention. Other features and benefits of any one or more of the embodiments will be apparent from the following detailed description and the claims.

The use of "a" or "an" is employed to describe elements and components described herein. This is done merely for convenience and to give a general sense of the scope of the invention. Accordingly, this description should be read to include one or at least one and the singular also includes the plural unless it is obvious that it is meant otherwise.

Furthermore, as used herein, the terms "comprises," "comprising," "includes," "including," "has," "having" or any other variation thereof are intended to cover a non-exclusive inclusion. For example, a component, structure, article, or apparatus that comprises a list of elements is not necessarily limited to only those elements but may include other elements not expressly listed or inherent to such component, structure, article, or apparatus.

As used herein, the terms "gas" and "air" are used interchangeably to refer to air or any other gas or gaseous elements useful for inflating an air mattress.

Figure 1A:
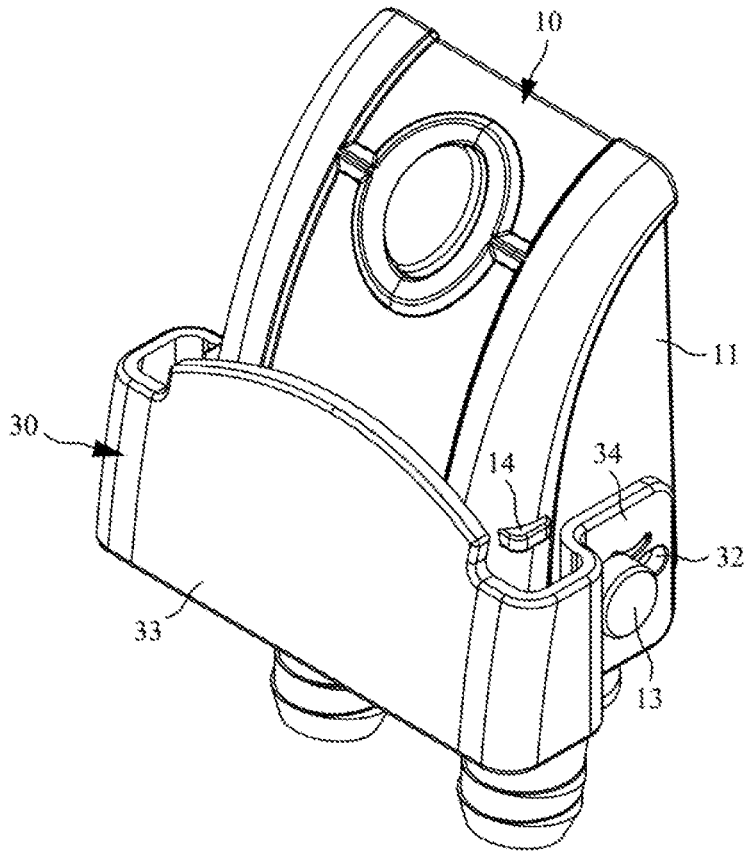
FIG. 1A illustrates the first embodiment of a gas communication device according to the present invention.
Figure 1B:
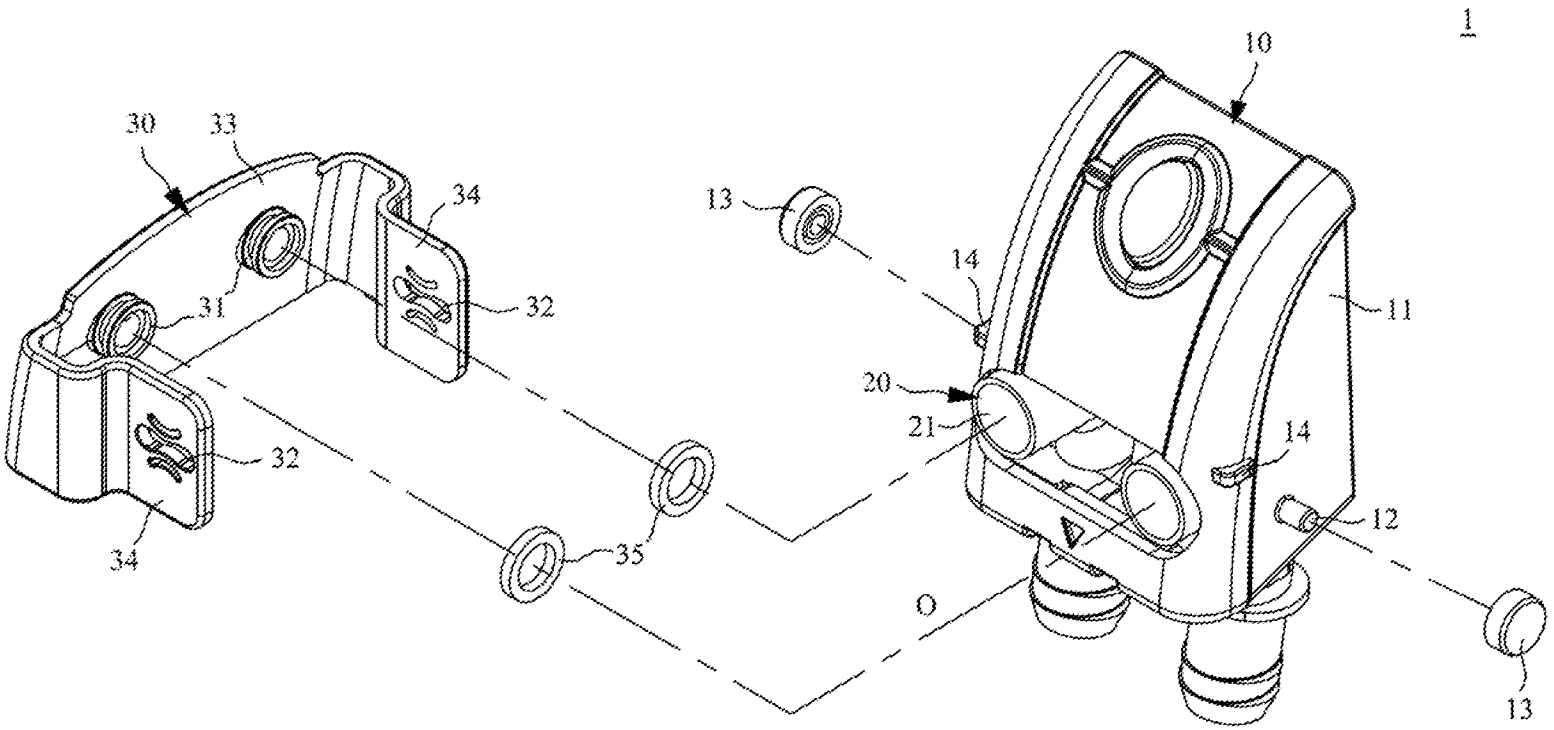
FIG. 1B illustrates a partial exploded view of the first embodiment of a gas communication device according to the present invention.
Figure 2:
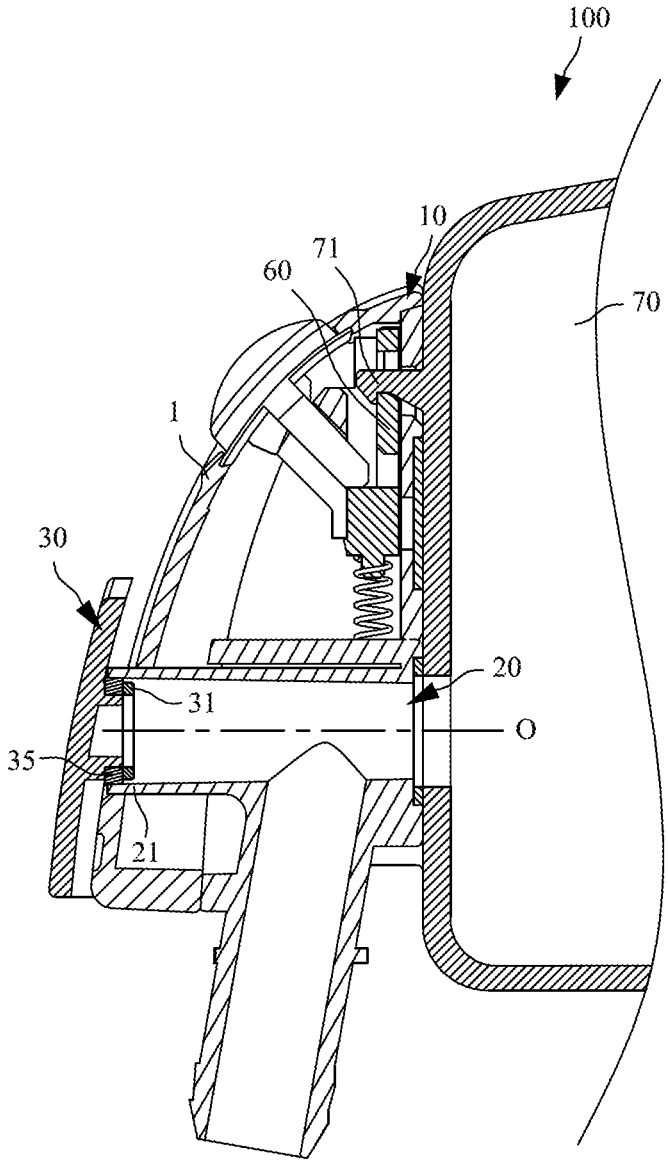
FIG. 2 illustrates a cross-sectional view of the first embodiment of a gas communication device according to the present invention used in conjunction with a gas supplier to form an inflation and deflation apparatus.

Refer concurrently to FIG. 1A to FIG. 2, wherein FIG. 1A illustrates the first embodiment of the gas communication device 1, FIG. 1B illustrates a partial exploded view of the first embodiment of the gas communication device 1, and FIG. 2 illustrates a cross-sectional view of the first embodiment of the gas communication device 1 used in conjunction with a gas supplier 70 to form an inflation and deflation apparatus 100. In the first embodiment, the gas communication device 1 comprises a main body 10, at least one gas delivery pipe 20 and a cover 30. In this invention, the main body 10 refers to a main portion of a physical structure and may be designed as one-piece integrally formed or a combination of multiple components. The main body 10 may comprise an outer surface 11. Generally, the main body 10 may act as a reference for the movements of respective movable elements and as a matrix for the connection of various elements or structures. As illustrated in FIG. 2, when the gas communication device 1 is connected with the gas supplier 70, an inflation and deflation apparatus 100 is formed. To facilitate the connection, the gas communication device 1 has an engagement structure 60, such as a movable pin or a hole, engageable with a corresponding structure 71, such as a hook, of the gas supplier 70. The gas supplier 70 may have an upper hook and a lower hook respectively engageable with the upper and lower engagement structures 60.

The gas delivery pipe 20 is at least partially disposed in the main body 10 and may be communicated with a device to be inflated and a gas supplier (not shown) to form gas communication therebetween. Each gas delivery pipe 20 may be a single linear pipe or a branched pipe. In this embodiment, the gas delivery pipe 20 has one end forming a gas outlet 21 exposed from the outer surface 11, and the gas delivery pipe 20 is elongated along an axis O as the central axis passing through the gas outlet 21.

The cover 30 is movably pivoted to the main body 10. In other words, in this embodiment, the cover 30 is connected with the main body 10 and is slidable and rotatable relative to the main body 10. The cover 30 comprises at least one sealing structure 31, a top portion 33 and two symmetrical side portions 34 connected with the top portion 33. Each sealing structure 31 is arranged on the inner side of the top portion 33, such that each sealing structure 31 may correspondingly seal each gas outlet 21.

In this embodiment, the cover 30 further comprises two sliding slots 32 respectively arranged at the side portions 33, such that each side portion 33 is provided with a sliding slot 32; the main body 10 further comprises two pivoting members 12 symmetrically formed on the outer surface 11, and each pivoting member 12 is corresponded to each sliding slot 32. When the cover 30 is assembled with the main body 10, each pivoting member 12 is located in each sliding slot 32, such that the cover 30 may slide relative to the main body 10 through the coordination of the sliding slots 32 and the pivoting members 12. In addition, in this embodiment, the gas communication device 1 further comprises two auxiliary securing members 13. Each auxiliary securing member 13 may be connected with each pivoting member 12 correspondingly after the cover 30 is assembled with the main body 10, such that each side portion 34 is arranged between each auxiliary securing member 13 and the main body 10, thereby preventing the separation of the cover 30 from the main body 10.

In this embodiment, each sliding slot 32 is configured as a dumbbell-like slot with two ends wider than the middle portion, such that when the cover 30 slides to locate each pivoting member 12 to one end of each sliding slot 32, the pivoting member 12 can be prevented from being unintentionally moved to the other end to provide temporarily positioning. In other embodiments, each sliding slot 32 may also be configured as a linear slot or other shapes.

It should be noted that the pivoting members 12 of the main body 10 and the corresponding sliding slots 32 of the cover 30 may be configured interchangeably; in other words, according to different needs, two pivoting members may be arranged on the cover 30, and two corresponding sliding slots may be arranged on the main body 10, thereby enabling the cover 30 to slide relative to the main body 10 in a similar way; moreover, a different structural assembly with similar function can be used to replace the pivoting members 12 and the sliding slots 32.

In this invention, the cover 30 further comprises at least one airtight member 35 correspondingly sleeved on the sealing structure 31 to enhance the airtightness of the seal formed by the sealing structure 31 on the gas outlet 21. The airtight member 35 may be an elastic ring member made by such as rubber or foam or other materials with better sealing capability, but this invention is not limited thereto.

In addition, in one embodiment, the gas communication device 1 further comprises at least one stop member 14 protrudingly arranged on the outer surface 11 of the main body 10 to limit the rotation direction of the cover 30 relative to the main body 10.

As illustrated in FIG. 1A and FIG. 2, in this embodiment, when the cover 30 of the gas communication device 1 is closed, the sealing structure 31 of the cover 30 is fittingly inserted into the gas delivery pipe 20 from the gas outlet 21, such that the sealing structure 31 in conjunction with the airtight member 35 may properly seal the gas outlet 21, and at the same time the cover 30 is restrained from moving at a direction perpendicular to the axis O and therefore not rotatable but only movable along the axis O.

Figure 3A:
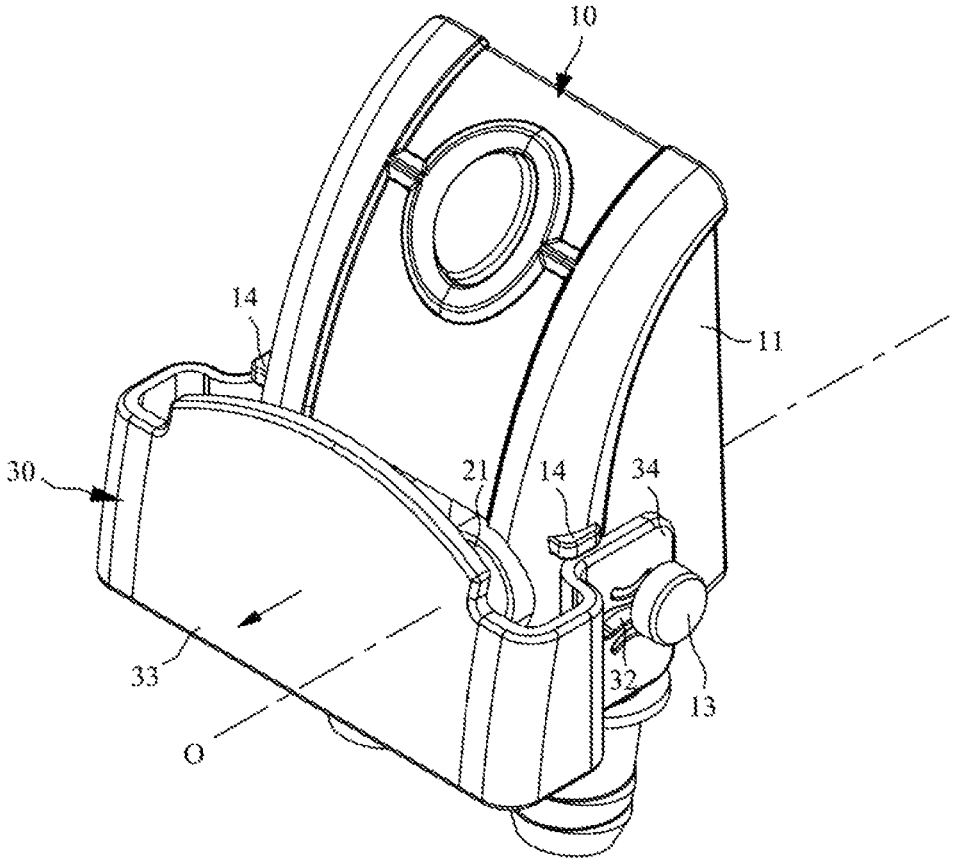
FIG. 3A illustrates the first embodiment of a gas communication device according to the present invention when the cover is being opened.
Figure 3B:
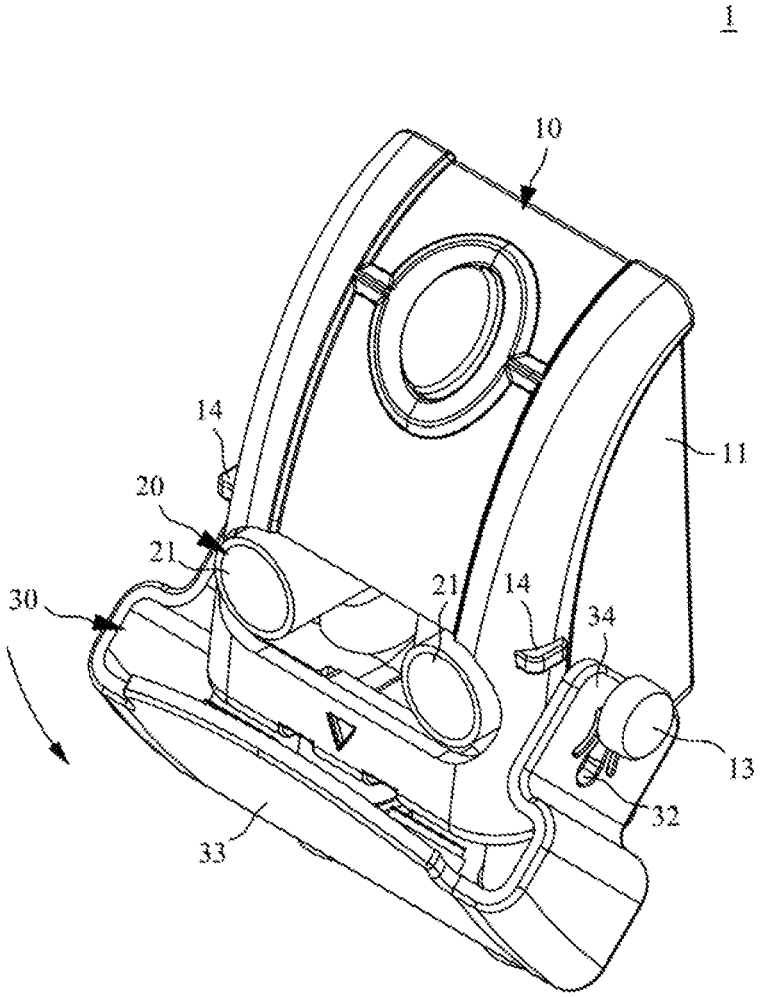
FIG. 3B illustrates the first embodiment of a gas communication device according to the present invention after the cover has been opened.
Figure 3C:
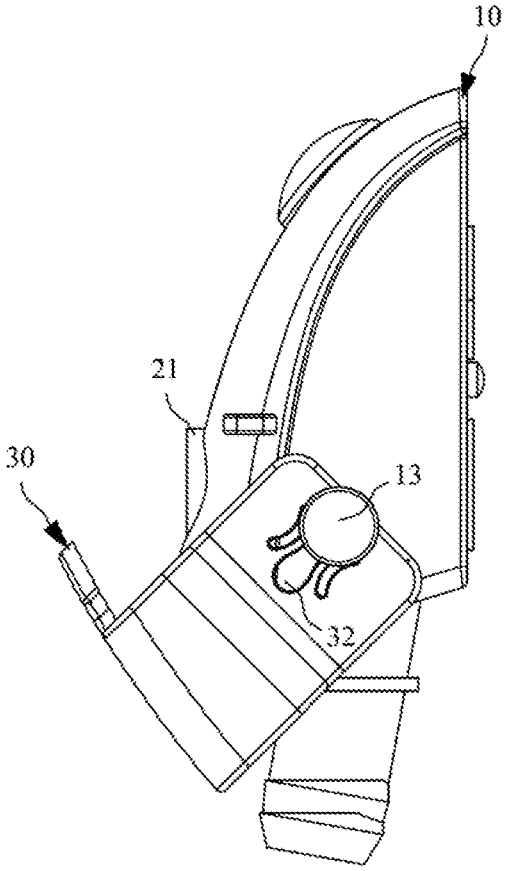
FIG. 3C illustrates a side view of the first embodiment of a gas communication device according to the present invention after the cover has been opened.

Refer concurrently to FIG. 1A and FIGS. 3A to 3C, wherein FIG. 3A illustrates the first embodiment of the gas communication device 1 when the cover 30 is being opened, FIG. 3B illustrates the first embodiment of the gas communication device 1 after the cover 30 has been opened, and FIG. 3C illustrates a side view of the first embodiment of the gas communication device 1 after the cover 30 has been opened. In this embodiment, the gas communication device 1 enables the cover 30 to be opened in two stages. When the cover 30 of the gas communication device 1 is closed, as shown in FIG. 1A, a user has to first move the cover 30 along the axis O away from the main body 10 in the direction indicated by the arrow in FIG. 3A such that the cover 30 slides linearly relative to the main body 10, thereby removing the sealing structure 31 of the cover 30 from the gas outlet 21 to break the seal on the gas outlet 21 and complete the first stage of the opening operation of the cover 30, as illustrated in FIG. 3A.

After that, because the sealing structure 31 of the cover 30 no longer restrains the cover 30 from moving at a direction perpendicular to the axis O, the user may now rotate the cover 30 relative to the main body 10 to expose the gas outlet 21 of the gas delivery pipe 20. Since at least one stop member 14 is arranged, the rotation direction of the cover 30 relative to the main body 10 is limited; therefore, in this embodiment, the cover 30 can only rotate downwardly in the direction indicated by the arrow in FIG. 3B, thereby completing the second stage of the opening operation of the cover 30, as illustrated in FIG. 3C.

Accordingly, the gas communication device 1 employs the cover 30 which may be opened in two stages, such that the user has to linearly slide the cover 30 relative to the main body 10 and then rotate the cover 30 relative to the main body 10 to expose the gas outlet 21, thereby providing an operational mechanism for preventing the user from unintentionally actuating the gas outlet 21 and breaking the seal, so as to increase the safety in use.

Figure 4A:
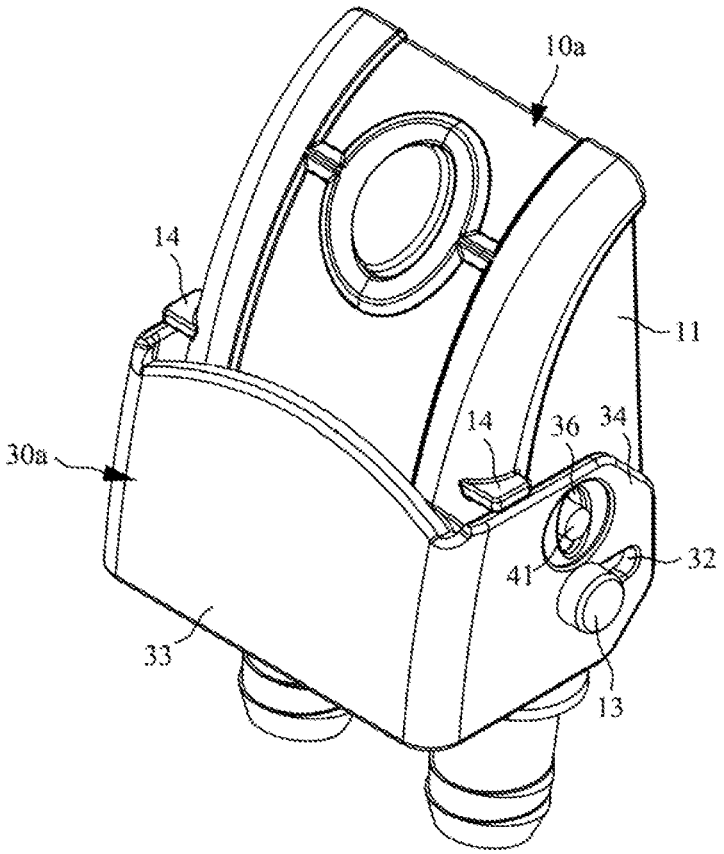
FIG. 4A illustrates the second embodiment of a gas communication device according to the present invention.
Figure 4B:
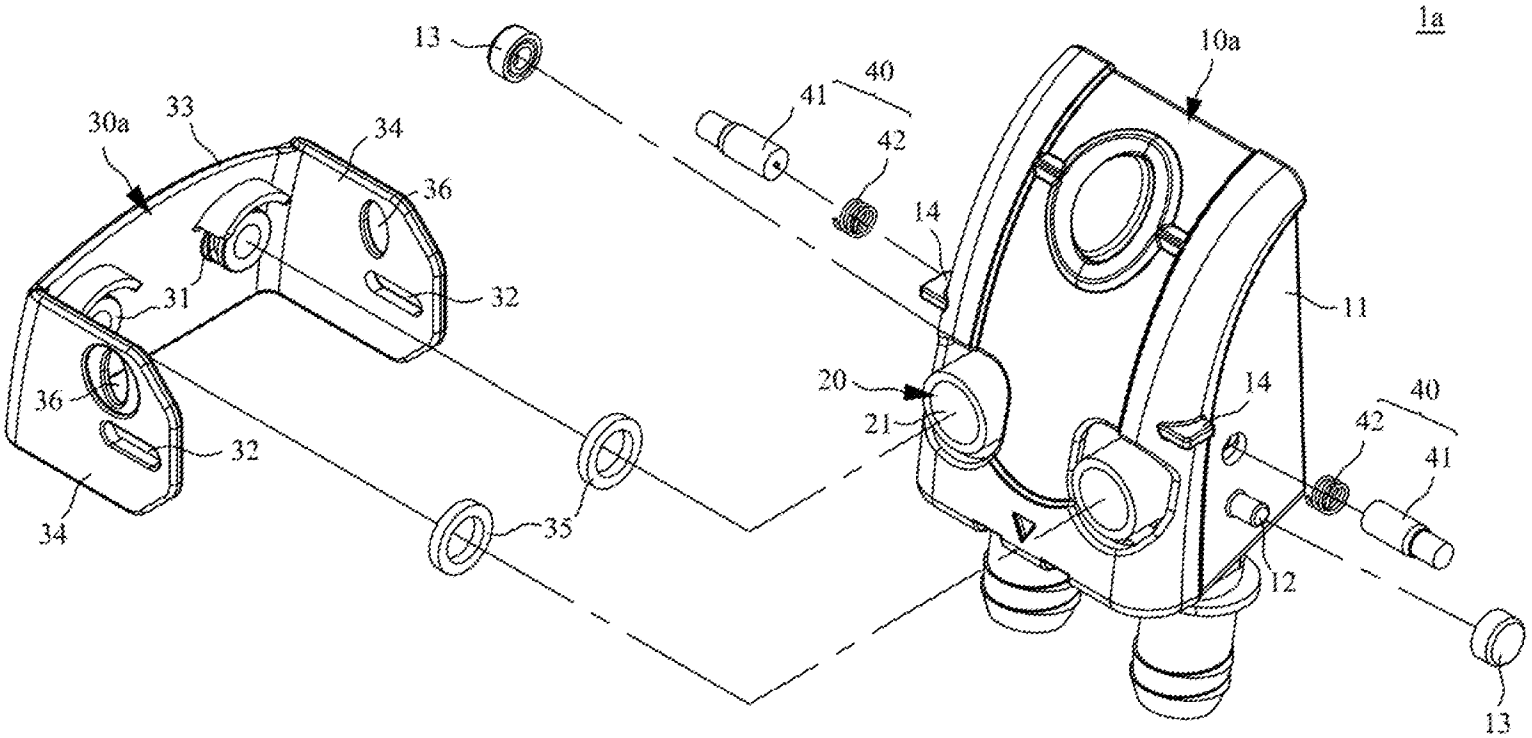
FIG. 4B illustrates a partial exploded view of the second embodiment of a gas communication device according to the present invention.

Refer to FIG. 4A and FIG. 4B, wherein FIG. 4A illustrates the second embodiment of the gas communication device 1*a*, and FIG. 4B illustrates a partial exploded view of the second embodiment of the gas communication device 1*a*. The second embodiment is a variation of the first embodiment, wherein a locking module adapted to lock the cover and corresponding structures are provided to further prevent unintentional actuation of the cover, and the rest arrangement is the same as described in the first embodiment. As shown in FIG. 4A and FIG. 4B, the gas communication device 1*a* further comprises at least one locking module 40 for limiting the cover 30*a* from moving or rotating relative to the main body 10*a*. In this embodiment, two locking modules 40 are respectively arranged at two sides of the main body 10*a* to correspondingly lock the two side portions 34 of the cover 30*a*.

In this embodiment, each locking module 40 comprises a press member 41 and an elastic member 42; the press member 41 is at least partially protruded from the outer surface 11 of the main body 10*a* and is capable of performing linear movement relative to the main body 10*a*; the elastic member 42 has two ends abutted against the press member 41 and the main body 10*a* respectively to provide elastic resilience to the press member 41 after its movement relative to the main body 10*a*. Corresponding to the arrangement of the locking modules 40, the cover 30*a* further comprises at least one locking hole 36 to be passed through by each press member 41.

When the cover 30*a* is combined with the main body 10*a*, each pivoting member 12 is arranged in each sliding slot 32, such that the cover 30*a* may slide relative to the main body 10*a* through the coordination of the sliding slots 32 and the pivoting members 12. Similarly, each auxiliary securing member 13 is connected with each pivoting member 12 correspondingly after the cover 30*a* is assembled with the main body 10*a*, such that each side portion 34 is arranged between each auxiliary securing member 13 and the main body 10*a*. Unlike the first embodiment, in the second embodiment, when the cover 30*a* is combined with the main body 10*a*, each press member 41 may pass through the locking hole 36 of the cover 30*a* so as to form another restraint limiting the movement of the cover 30*a*. Therefore, the use of locking modules 40 may provide locking to the cover 30*a* of the gas communication device 1*a* before it is opened.

Figure 5A:
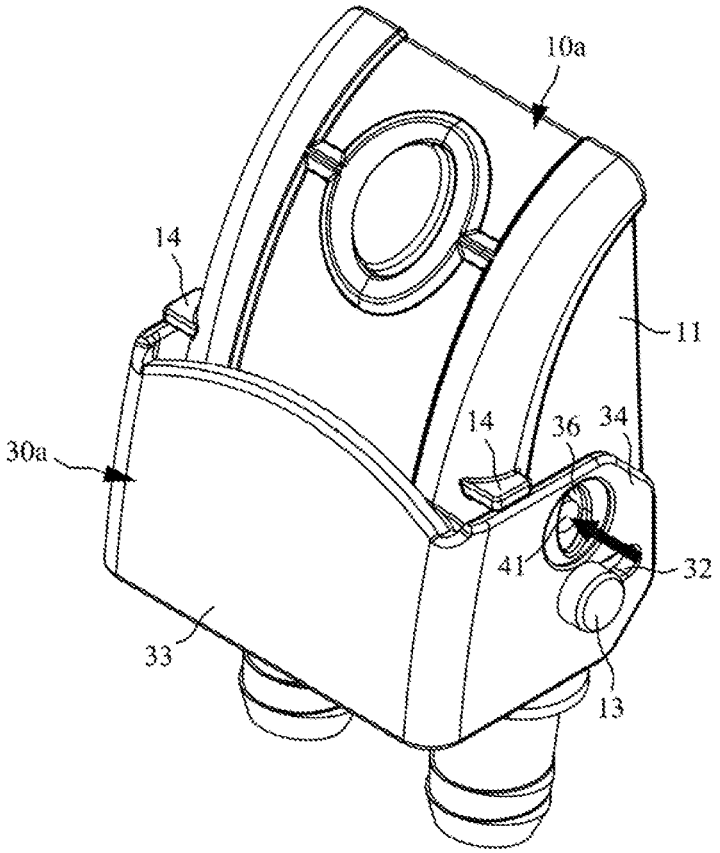
FIG. 5A illustrates the second embodiment of a gas communication device according to the present invention in the first stage for opening the cover.
Figure 5B:
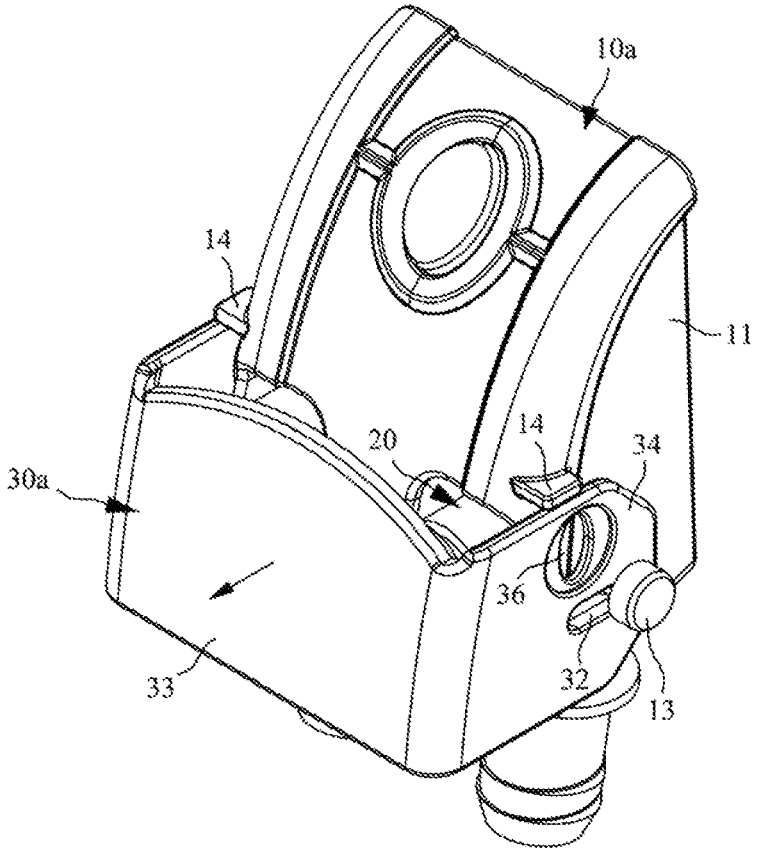
FIG. 5B illustrates the second embodiment of a gas communication device according to the present invention in the second stage for opening the cover.
Figure 5C:
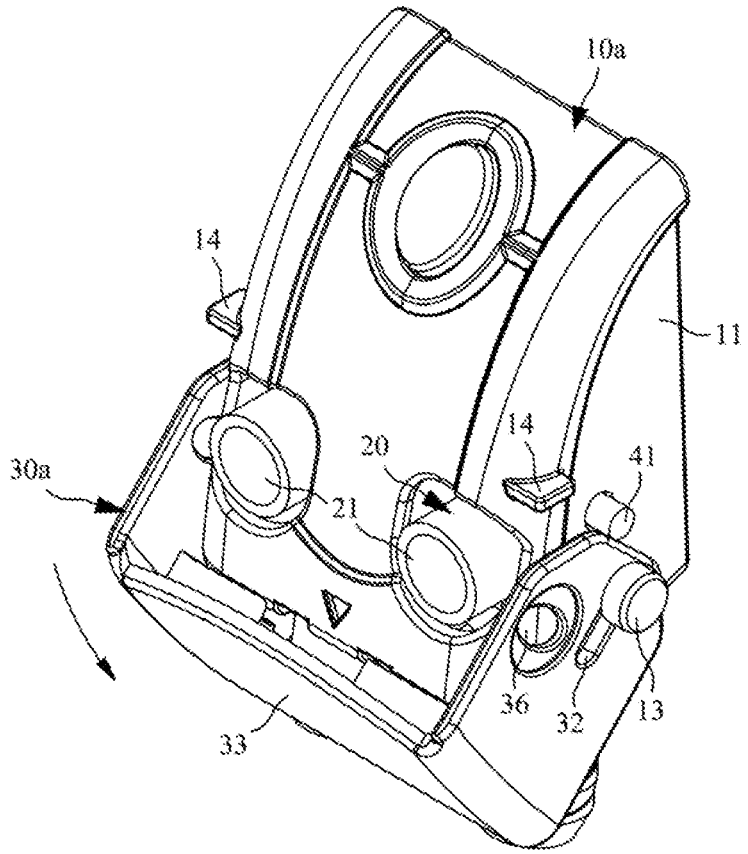
FIG. 5C illustrates the second embodiment of a gas communication device according to the present invention after the cover has been opened.

Refer to FIG. 5A to FIG. 5C, wherein FIG. 5A illustrates the second embodiment of the gas communication device 1*a* in the first stage for opening the cover 30*a*, FIG. 5B illustrates the second embodiment of the gas communication device 1*a* in the second stage for opening the cover 30*a*, and FIG. 5C illustrates the second embodiment of the gas communication device 30*a* after the cover 30*a* has been opened. In this embodiment, the gas communication device 1*a* employs a three-stage opening mechanism for the cover 30*a*. When the cover 30*a* of the gas communication device 1*a* is closed as illustrated in FIG. 5A, the user has to first unlock the cover 30*a* from the locking modules 40, which can be made by pressing each press member 41 in the direction illustrated by the arrow shown in FIG. 5A, such that the press member 41 is pressed and contracted backward from the locking hole 36, such as retreated inward from the outer surface 11 of the main body 10*a*, so as to complete the first operational stage for opening the cover 30*a*.

Next, when the cover 30*a* is no longer locked by the locking modules 40, the user may, as described in the first embodiment, slide the cover 30*a* in the direction away from the main body 10*a*, such as the direction indicated by the arrow in FIG. 5B, to remove the sealing structure (not shown) of the cover 30*a* from the gas outlet 21, so as to unseal of the gas outlet 21 and complete the second operational stage for opening the cover 30*a*, as illustrated in FIG. 5B, during which each press member 41 is pressed by the side portion 34 of the cover 30*a* and retreated inward from the outer surface 11 of the main body 10*a*.

Afterward, the user may rotate the cover 30*a* relative to the main body 10*a* so as to expose the gas outlet 21 of the gas delivery pipe 20. During the rotation, the at least one stop member 14 may similarly limit the rotation direction of the cover 30*a* relative to the main body 10*a*, such that the cover 30*a* may only be rotated in the direction indicated by the arrow in FIG. 5C. Accordingly, the third operational stage for opening the cover 30*a* can be done, as illustrated in FIG. 5C.

Therefore, the gas communication device 1*a* in this embodiment provides three operational stages for opening the cover 30*a*, by which the user has to first unlock the locking modules 40 from the cover 30*a*, then slide the cover 30*a* linearly relative to the main body 10*a* and then rotate the cover 30*a* relative to the main body 10*a* to expose the gas outlet 21. The aforesaid configuration may ensure safety in use and prevent unintentional actuation of the cover 30*a*.

Figure 6A:
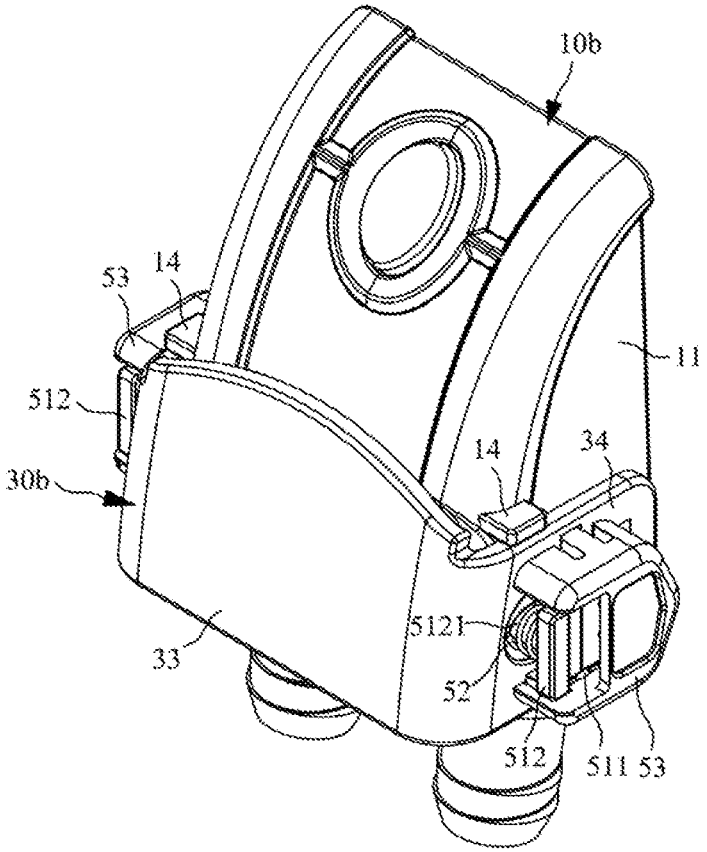
FIG. 6A illustrates the third embodiment of a gas communication device according to the present invention.
Figure 6B:
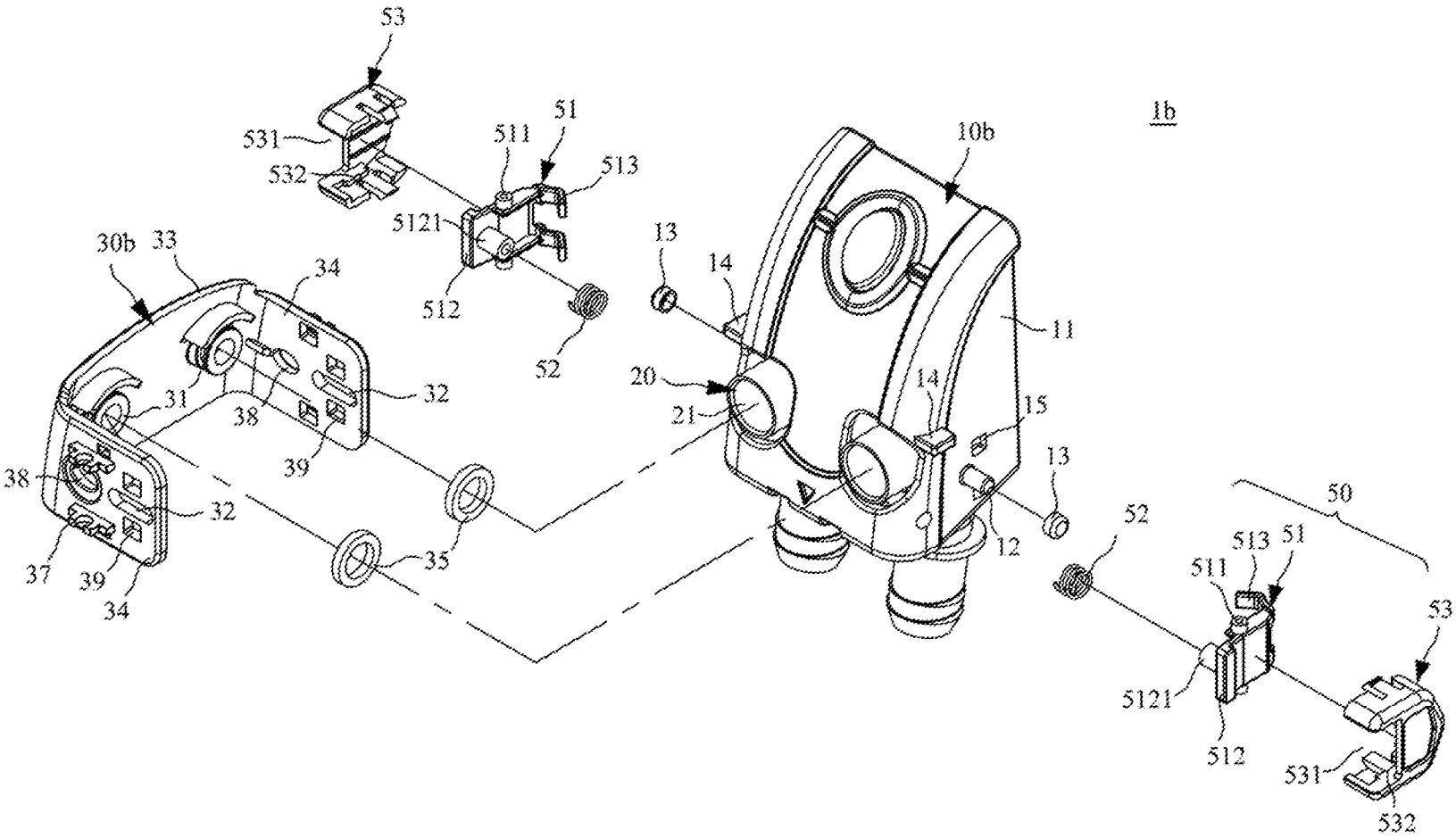
FIG. 6B illustrates a partial exploded view of the third embodiment of a gas communication device according to the present invention.

Refer to FIG. 6A and FIG. 6B, wherein FIG. 6A illustrates the third embodiment of the gas communication device 1*b*, and FIG. 6B illustrates a partial exploded view of the third embodiment of the gas communication device 1*b*. The third embodiment is a variation of the second embodiment, wherein the locking module for locking the cover is modified to increase the operational safety and prevent unintentional actuation and movement of the cover, and the rest arrangement is the same as described in the second embodiment. As illustrated in FIG. 6A and FIG. 6B, the gas communication device 1*b* further comprises at least one locking module 50 for restraining the cover 30*b* from moving or rotating relative to the main body 10*a*. In this embodiment, two locking modules 50 are respectively arranged at two sides of the main body 10*b* to correspondingly locking the two side portions 34 of the cover 30*b*.

In this embodiment, each locking module 50 comprises a locking member 51 pivotally connected with the cover 30*b* to rotate and swing like a lever relative to the cover 30*b*. Each locking member 51 comprises a pivoting part 511, a manipulation part 512 and a hooking part 513; the manipulation part 512 and the hooking part 513 are respectively arranged at two ends of the locking member 51, and the pivoting part 511 is configured between the manipulation part 512 and the hooking part 513. Therefore, when the locking member 51 is pivotally connected to the cover 30*b* with the pivoting part 511, the locking member 51 may rotate and swing relative to the cover 30*b* using the pivoting part 511 as the fulcrum. The cover 30*b* further comprises at least one holding part 37 arranged at the side portion 34 of the cover 30*b* for correspondingly holding the pivoting part 511 of the locking member 51. In this embodiment, the holding part 37 is configured as a C-shaped engagement member for holding and securing the cylindrical pivoting part 511, but the holding part 37 may also be configured as other structures and shapes.

In this embodiment, each locking module 50 further comprises a spring 52, and the manipulation part 512 comprises a column 5121, such that the spring 52 is sleeved on the column 5121 with its two ends respectively abutted against the manipulation part 512 and the cover 30*b* to provide elastic resilience to and reposition the manipulation part 512 after it has rotated and swung relative to the cover 30*b*. The cover 30*b* further comprises at least one first hole 38 on each side portion 34 corresponding to the position of the column 5121, such that when the user rotate and swing the manipulation part 512 toward the side portion 34 of the cover 30*b*, the column 5121 may pass through the first hole 38.

The cover 30*b* further comprises at least one second hole 39 on each side portion 34 of the cover 30*b* corresponding to the position of the hooking part 513 and passed through by the hooking part 513. The main body 10*b* further comprises at least one notch 15 arranged on the outer surface 11 of the main body 10*b* and corresponding to the position of each hooking part 513, such that the hooking part 513 of the locking member 51 may pass through the cover 30*b* and into the corresponding notch 15.

In addition, in this embodiment, each locking module 50 further comprises a protective cover 53 connected with the cover 30*b*, such that the locking member 51 is secured between the protective cover 53 and the cover 30*b*. The protective cover 53 comprises an opening 531 arranged at one side corresponding to the manipulation part 512 of the locking member 51. Thus, after the protective cover 53 has been connected to the cover 30*b*, the manipulation part 512 is exposed by the opening 531 to enable convenient manipulation by the user. In addition, the protective cover 53 may further prevent unintentional actuation and unlocking of the locking member 51.

Each protective cover 53 further comprises an auxiliary holding part 532 arranged on one side of the protective cover 53 facing the locking member 51 to operate in coordination with the holding part 37 of the cover 30*b* for holding the pivoting part 511 of each locking member 51. In this embodiment, the auxiliary holding part 532 is configured as a curved notch corresponding to the C-shape engagement member of the holding part 37, such that the pivoting part 511 of each locking member 51 is secured between the holding part 37 and the auxiliary holding part 532. Generally, the auxiliary holding part 532 has a structure which is variable correspondingly to the structure of the holding part 37.

When the cover 30*b* is connected with the main body 10*b*, each pivoting member 12 is positioned in each sliding slot 32, such that the cover 30*b* may slide relative to the main body 10*b* through the coordination of the sliding slot 32 and the pivoting member 12; in addition, each auxiliary securing member 13 is connected with the corresponding pivoting member 12 after the cover 30*b* is connected with the main body 10*b*, such that each side portion 34 is secured between each auxiliary securing member 13 and the main body 10*b*.

Figure 7A:
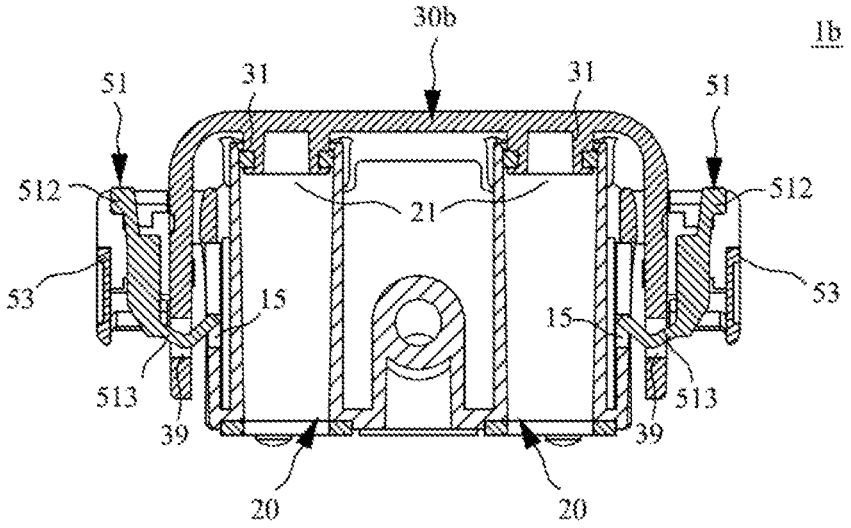
FIG. 7A illustrates a cross-sectional view of the third embodiment of a gas communication device according to the present invention when the cover has not been unlocked.

Refer to FIG. 7A for a cross-sectional view of the third embodiment of the gas communication device 1*b* when the cover 30*b* has not been unlocked. As illustrated in FIG. 6A and FIG. 7A, the third embodiment is different from the second embodiment in that when the cover 30*b* of the gas communication device 1*b* is closed, each locking module 50 has its hooking part 513 of the locking member 51 passed through the second hole 39 of the cover 30*b* and inserted into the notch 15 of the main body 10*b*, such that the hooking part 513 is engaged with the notch 15 of the main body 10*b* to lock the cover 30*b* to the main body 10*b*. Therefore, the locking module 50 may also provide the locking function before the cover 30*b* of the gas communication device 1*b* is opened.

Figure 7B:
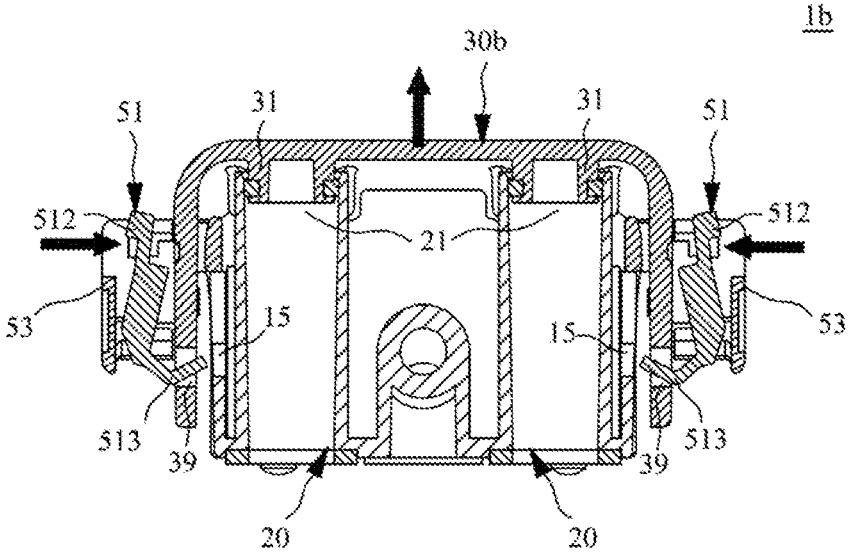
FIG. 7B illustrates a cross-sectional view of the third embodiment of a gas communication device according to the present invention in the first stage for opening the cover.
Figure 8A:
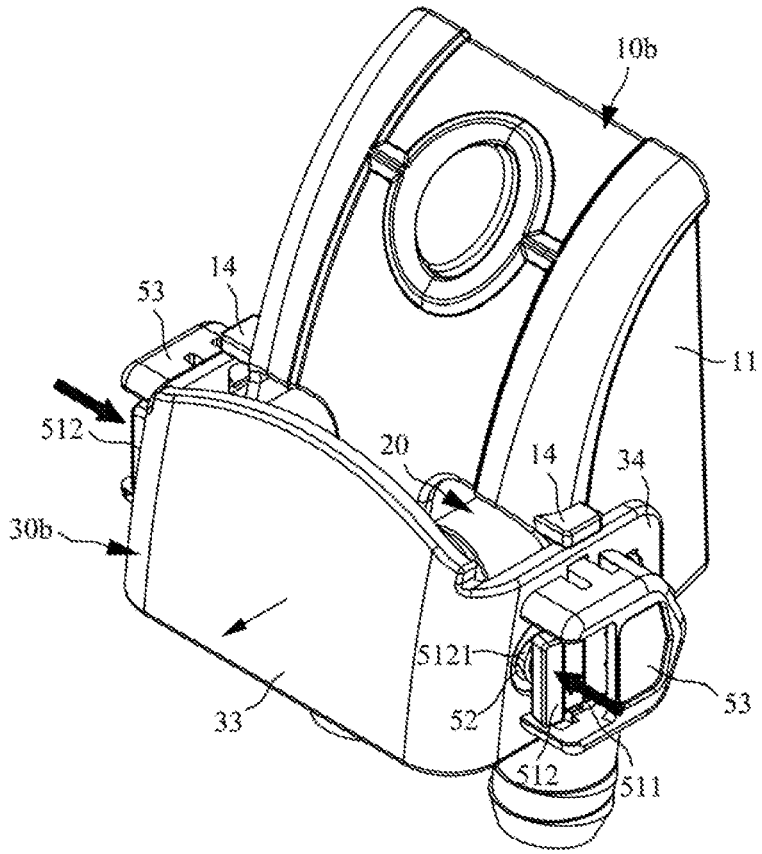
FIG. 8A illustrates the third embodiment of a gas communication device according to the present invention in the second stage for opening the cover.
Figure 8B:
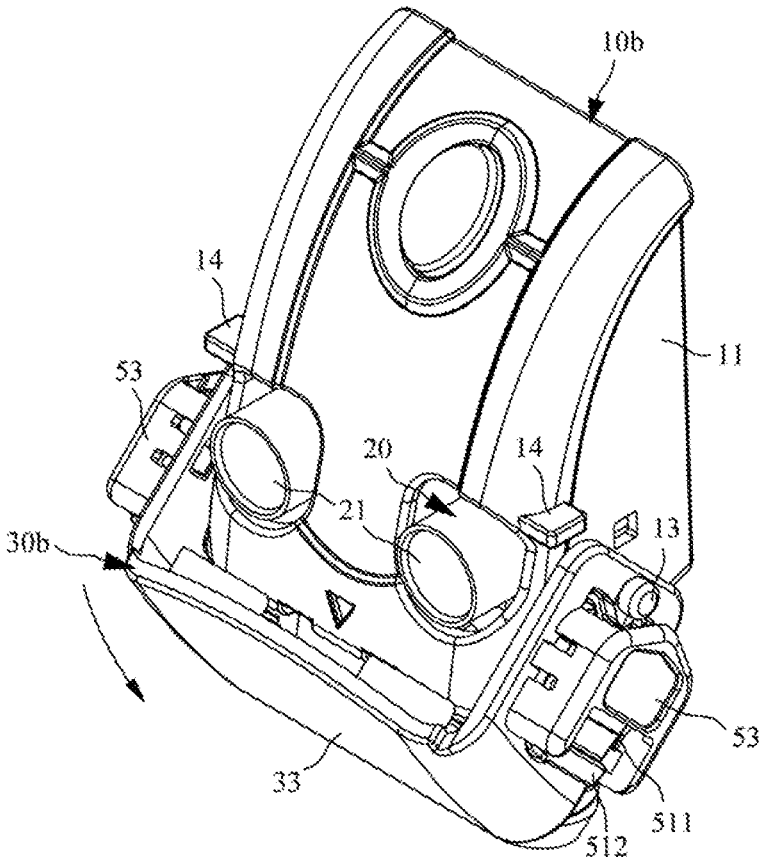
FIG. 8B illustrates the third embodiment of a gas communication device according to the present invention after the cover has been opened.

Refer concurrently to FIG. 7A through FIG. 8B, wherein FIG. 7B illustrates the third embodiment of the gas communication device 1*b* in the first stage for opening the cover 30*b*, FIG. 8A illustrates the third embodiment of the gas communication device 1*b* in the second stage for opening the cover 30*b*, and FIG. 8B illustrates the third embodiment of the gas communication device 1*b* after the cover 30*b* has been opened. In this embodiment, the gas communication device 1*b* also employs a three-stage opening design for the cover 30*b*. When the cover 30*b* of the gas communication device 1*b* is at the closed state illustrated in FIG. 7A, the user has to first unlock each locking module 50 from the cover 30*b*, such that when the manipulation part 512 of each locking member 51 is pressed in the direction indicated by the arrow shown in FIG. 7B, the hooking part 513 is moved in the opposite direction and disengaged from the notch 15 of the main body 10*b*, thereby unlocking each locking member 51 to complete the first stage of the opening operation of the cover 30*b*.

Next, after each locking module 50 has been unlocked, similar to the first embodiment, the user may slide the cover 30*b* away from the main body 10*b* in the direction indicated by the arrow on the cover 30*b* shown in FIG. 7B, such that the sealing structure 31 of the cover 30*b* is removed from the gas outlet 21 to unseal the gas outlet 21, thereby completing the second stage of the opening operation of the cover 30*b*, as illustrated in FIG. 8A.

Finally, the user rotates the cover 30*b* relative to the main body 10*b* to expose the gas outlet 21 of the gas delivery pipe 20. During the rotation, the at least one stop member 14 may similarly limit the rotation direction of the cover 30*b* relative to the main body 10*b*, such that the cover 30*b* may only be rotated in the direction indicated by the arrow in FIG. 8B, thereby completing the third operational stage for opening the cover 30*b*, as illustrated in FIG. 8B.

Accordingly, the gas communication device 1*b* in this embodiment also provides three operational stages for opening the cover 30*b*, by which the user has to first unlock the locking modules 50, then slide the cover 30*b* linearly relative to the main body 10*b* to break the seal of the gas outlet 21 and then rotate the cover 30*b* relative to the main body 10*b* to expose the gas outlet 21. The aforesaid configuration may further ensure safety in use and greatly prevent unintentional actuation of the cover 30*b*.

The above detailed description is merely illustrative in nature and is not intended to limit the embodiments of the subject matter or the application and uses of such embodiments. Moreover, while at least one exemplary embodiment has been presented in the foregoing detailed description, it should be appreciated that a vast number of variations exist. It should also be appreciated that the exemplary one or more embodiments described herein are not intended to limit the scope, applicability, or configuration of the claimed subject matter in any way. Rather, the foregoing detailed description will provide those skilled in the art with a convenient guide for implementing the described one or more embodiments. Also, various changes can be made in the function and arrangement of elements without departing from the scope defined by the claims, which include known equivalents and foreseeable equivalents at the time of filing this patent application.

What is claimed is:

1. A gas communication device, comprising:

a main body;

at least one gas delivery pipe which is at least partially disposed in the main body, the gas delivery pipe forming a gas outlet at one end;

a cover movably pivoted to the main body, the cover comprising at least one sealing structure for correspondingly sealing the gas outlet; and at least one locking module for limiting the cover from moving or rotating relative to the main body, the locking module comprising a spring and a locking member which comprises a pivoting part, a manipulation part and a hooking part, the manipulation part and the hooking part being arranged at two ends of the locking member, the pivoting part being arranged between the manipulation part and the hooking part, and the locking member being pivotally connected to the cover with the pivoting part, the manipulation part comprising a column, the spring being sleeved on the column and having two ends respectively abutted against the manipulation part and the cover;

wherein the cover is movable along an axis relative to the main body and away from the gas outlet so as to break the seal of the sealing structure on the gas outlet such that the cover is rotatable relative to the main body so as to deviate from the axis to expose the gas outlet.

2. The gas communication device of claim 1, wherein the main body comprises two pivoting members symmetrically arranged, and the cover further comprises two sliding slots, such that the pivoting members are respectively disposed in the sliding slots to enable the cover to move relative to the main body along the axis.

3. The gas communication device of claim 1, wherein the main body comprises two sliding slots symmetrically arranged, and the cover further comprises two pivoting members, such that the pivoting members are respectively disposed in the sliding slots to enable the cover to move relative to the main body along the axis.

4. The gas communication device of claim 2, wherein the cover further comprises a top portion and two symmetrical side portions connected with the top portion, the sealing structure is arranged on the inner side of the top portion, and each sliding slot is correspondingly arranged at each side portion.

5. The gas communication device of claim 4, further comprising two auxiliary securing members respectively connected to the pivoting members, such that each side portion is correspondingly arranged between each auxiliary securing member and the main body.

6. The gas communication device of claim 1, further comprising at least one stop member protruded from the outer surface of the main body for limiting the rotation of the cover.

7. The gas communication device of claim 1, wherein the cover further comprises at least one airtight member sleeved on the sealing structure to enhance the airtightness of the seal between the sealing structure and the gas outlet.

8. The gas communication device of claim 7, wherein the sealing structure is fittingly inserted into the gas delivery pipe.

9. The gas communication device of claim 1, wherein the locking module comprises a press member, the cover comprises at least one locking hole, and the press member passes through the locking hole.

10. The gas communication device of claim 9, wherein the locking module further comprises an elastic member for providing elastic resilience to the press member.

11. The gas communication device of claim 1, wherein the main body further comprises at least one notch, and the hooking part of the locking member passes through the cover and extends into the notch.

12. The gas communication device of claim 1, wherein the cover further comprises at least one holding part for correspondingly holding the pivoting part of the locking member.

13. The gas communication device of claim 12, wherein the locking module further comprises a protective cover connected with the cover in such a way that the locking member is disposed between the protective cover and the cover, the protective cover comprising an opening exposing the manipulation part of the locking member.

14. The gas communication device of claim 13, wherein the protective cover further comprises an auxiliary holding part arranged on one side of the protective cover facing the locking member, such that the pivoting part of the locking member is held by the auxiliary holding part in conjunction with the holding part of the cover.

15. The gas communication device of claim 13, further comprising an engagement structure to be connected with a gas supplier.

16. An inflation and deflation apparatus comprising a gas communication device and a gas supplier, wherein the gas communication device comprises a main body; at least one gas delivery pipe at least partially disposed in the main body and forming a gas outlet at one end; a cover movably pivoted to the main body, the cover comprising at least one sealing structure for correspondingly sealing the gas outlet and being movable along an axis relative to the main body and away from the gas outlet so as to break the seal of the sealing structure on the gas outlet such that the cover is rotatable relative to the main body so as to deviate from the axis to expose the gas outlet; at least one locking module for limiting the cover from moving or rotating relative to the main body, the locking module comprising a spring and a locking member which comprises a pivoting part, a manipulation part and a hooking part, the manipulation part and the hooking part being arranged at two ends of the locking member, the pivoting part being arranged between the manipulation part and the hooking part, and the locking member being pivotally connected to the cover with the pivoting part, the manipulation part comprising a column, the spring being sleeved on the column and has two ends respectively abutted against the manipulation part and the cover; and an engagement structure connected with the gas supplier;

and wherein the gas communication device is separable from the gas supplier when the gas communication device is disengaged sequentially from an upper portion and a lower portion of the gas communication device.

* * * * *